United States Patent [19]

O'Riordain

[11] 4,274,238

[45] Jun. 23, 1981

[54] ROOF STRUCTURE

[75] Inventor: Diarmuid O'Riordain, Condae Luimnighe, Ireland

[73] Assignee: Southern Chemicals Limited, Limerick, Ireland

[21] Appl. No.: 936,310

[22] Filed: Aug. 23, 1978

[51] Int. Cl.[3] ..... E04B 5/00

[52] U.S. Cl. ..... 52/408; 52/409; 52/309.9; 428/141; 428/305; 428/321

[58] Field of Search ..... 52/408, 409, 410, 199, 52/309.9; 428/141, 305, 321

[56] References Cited

U.S. PATENT DOCUMENTS

| | | | |
|---|---|---|---|
| 3,411,256 | 11/1968 | Best | 52/408 |
| 3,763,614 | 10/1973 | Hyde | 52/309.9 |
| 3,892,899 | 7/1975 | Klein | 52/408 |
| 4,073,997 | 2/1978 | Richards | 428/321 |

FOREIGN PATENT DOCUMENTS

| | | | |
|---|---|---|---|
| 640458 | 3/1964 | Belgium | 52/309.9 |
| 753715 | 1/1971 | Belgium | 52/408 |
| 1816577 | 6/1970 | Fed. Rep. of Germany | 52/199 |
| 2412386 | 9/1974 | Fed. Rep. of Germany | 52/199 |
| 2327840 | 12/1974 | Fed. Rep. of Germany | 52/408 |
| 2549993 | 5/1977 | Fed. Rep. of Germany | 52/408 |
| 79136 | 1/1971 | German Democratic Rep. | 52/309.9 |

*Primary Examiner*—Price C. Faw, Jr.
*Assistant Examiner*—H. E. Raduazo
*Attorney, Agent, or Firm*—Sughrue, Rothwell, Mion, Zinn and Macpeak

[57] ABSTRACT

The efficient drainage of flat roofs is facilitated by the inclusion in the construction of a flat roof of a drainage board, preferably of a bead material. The drainage board is provided above a water barrier layer and below a thermal insulation layer. Water falling on a flat roof passes readily through a protective layer of gravel or like material, through the abutting joints of the thermal insulation layer and through the drainage board. The water then flows on the water barrier layer to conventional water gulleys and downpipes.

8 Claims, 6 Drawing Figures

FIG. 3
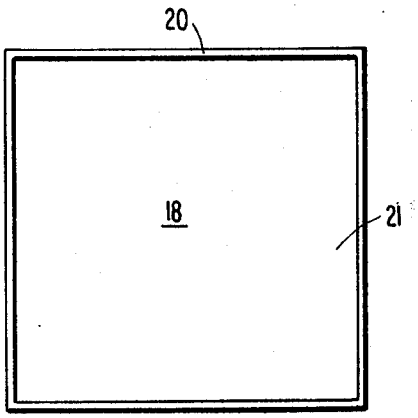
FIG. 4
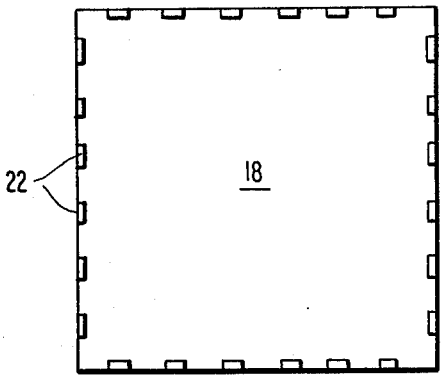
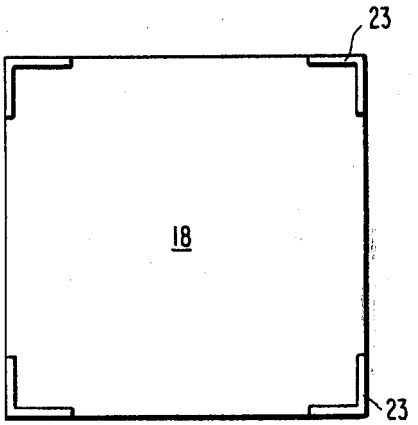
FIG. 5
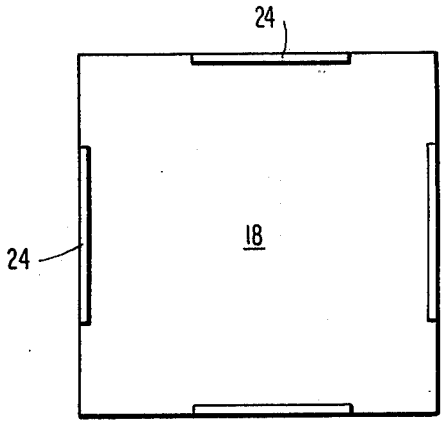
FIG. 6

ROOF STRUCTURE

This invention relates to roof construction and in particular to insulated flat roofs and their construction.

A number of constructions of roof structure are known which consist of an assembly of constitutent layers of material i.e., a vapour barrier, a thermal insulation layer and a water impermeable layer. The main disadvantage associated with the known construction of roof structure resides with the problem of the efficient disposal of water. Known constructions of flat roof structures can suffer from the combination of a high temperature gradient through the roof structure—say 70° F. in winter time—and trapped water lodged between layers of the roof structure. In winter weather freezing of water trapped between the roof layers, during construction of the roof for example, results in the formation of ice and consequent stress and strain on the layered roof structure. In summer time solar energy can cause the trapped water to vapourise and this water vapour will damage the water impermeable layer of the roof assembly by "bubbling" the material, crackling the material and breaking down joints.

The present invention is directed towards overcoming the stated disadvantages of the known roof construction by providing a flat roof structure comprising a roof deck supported in a conventional manner on a roof support means and, in the stated order, a water impermeable layer on the upper surface of the roof deck, a drainage board adapted to allow water to pass freely therethrough in both vertical and horizontal directions, a layer of cellular thermal insulation material adapted to allow water to pass therethrough, and a water permeable protective and weighting layer on the upper surface of the cellular thermal insulation material.

Preferably the roof deck is a flat concrete roof supported on a concrete roof support means. The layer of cellular thermal insulation material preferably consists of a plurality of foamed polystyrene boards jointed together by overlapping longitudinal and/or lateral edge portions, the water passing through said layer of cellular thermal insulation material by passing through said longitudinal and/or lateral joints. The drainage board is preferably of a foamed polystyrene bead material, the said bead material allowing a liquid to pass freely therethrough. The manner of production of the drainage board of foamed polystyrene material ensures that the said material has a maximum of voids consistent with a satisfactory mechanical strength. The water impermeable layer is preferably asphalt but other materials such as multi-layer bitumnous felt, PVC or butyl rubber are also suitable.

According to a further aspect of the invention there is provided a flat roof structure comprising a roof deck supported in a conventional manner on a roof support means and, in the stated order, a water impermeable layer on the upper surface of the roof deck, a drainage board adapted to allow water to pass freely therethrough in both vertical and horizontal directions a layer of cellular thermal insulation material adapted to allow water to pass therethrough, and a water permeable protective and weighting layer on the upper surface of the thermal insulation material, the drainage board and the layer of cellular insulation material being formed respectively from a plurality of jointed drainage panels and a plurality of jointed panels of insulation material and preferably being formed from a plurality of jointed laminate panel units each formed by securing together as a laminate unit a drainage board panel and the panels of insulation material. In the latter case the panels of cellular thermal insulation material are provided with means to locate and hold in position a complementary drainage panel for securing together the said panels to form the laminate panel unit. The panel of insulation material and the panel of drainage board are preferably adhesively secured togetheer to form the laminate panel unit.

The invention will be understood from the following description of an embodiment thereof given by way of example only with reference to the accompanying drawings in which:

FIGS. 3 to 6 are underneath views of alternative constructions of cellular thermal insulation panels used in forming laminate units.

Figure 2:
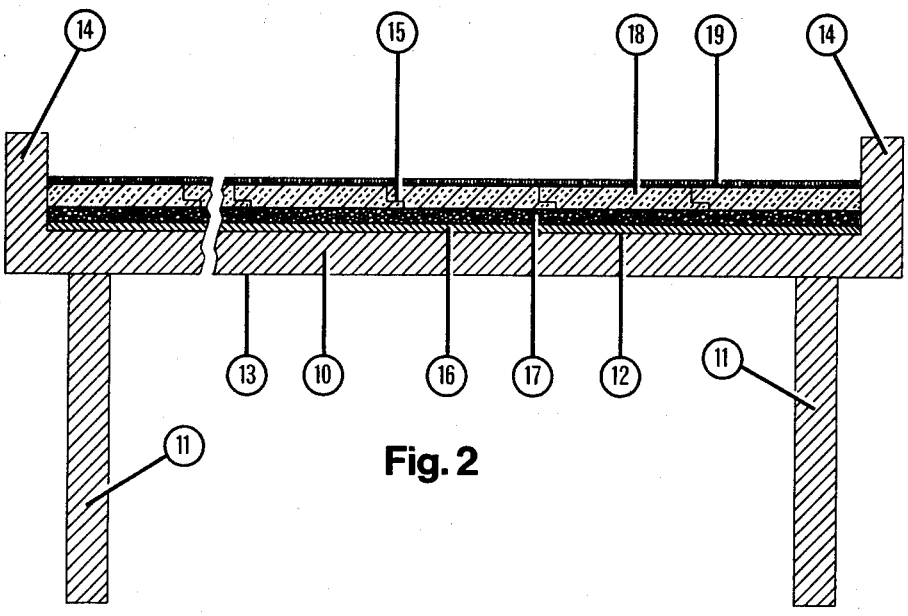
FIG. 2 is a cross-sectional view through the roof structure.

Referring to the accompanying drawings the roof structure comprises a concrete roof deck 10 supported by concrete support walls 11. The roof deck 10 has an upper surface 12 and a lower surface 13 and the support walls 11 extend beyond the upper surface 12 of the roof deck 10 to form kerb portions 14.

The roof deck 10 is provided on its upper surface 12 with one or more gulleys (not shown) connected to downpipes for the removal of rain water from the roof structure. The upper surface 12 of the roof deck has laid thereon a layer of asphalt 16 to a depth sufficient to form a water impermeable layer. A drainage board 17 is laid on the asphalt covered roof deck. A thermal insulation material—in this case a layer of water impermeable foamed polystyrene board 18—is provided. The boards 18 are jointed together by overlapping longitudinal and lateral edge portions 15 which permit water to pass through the joints. The boards 18 may be affixed to the drainage board 17 using a suitable adhesive. A protective layer of gravel 19 is laid upon the top of the thermal insulation material 18. The layer of gravel 19 serves the primary function of acting as a protective layer for the roof structure against the ravages of the weather and in addition serves to weigh down the roof structure.

The drainage board 17 which is foamed polystyrene bead material is produced by the following production steps.

(a) A predetermined quantity of uniform large sized polystyrene beads are prefoamed in a conventional manner using a steam treatment. The beads are preferably about 2–3 mm. diameter prior to prefoaming and are expanded to a bulk density, preferably not greater than 15 kg/cubic meter.

(b) The prefoamed polystyrene beads are then stored for a suitable time period in a ventilated hopper.

(c) The prefoamed polystyrene beads are then placed in a mould i.e., a mould designed to give a drainage board 12 ft×4 ft×2 ft. The mould when full is closed and the prefoamed beads are again subjected to heat, for example, a steam treatment. Moisture, air and the expanding agent i.e. pentane in the beads will expand, the polystyrene material softens and the expanded soft beads will stick together—to give a board having a clear bead structure with a large number of interconnected voids. Prior to being heat treated the prefoamed beads are to advantage coated with a material which facilitates an effective fusion of the area of contact between the beads.

In the last production step the degree of steam treatment is geared to achieve the minimum expansion in bead size consistent with achieving a good adhesion between the expanded beads, a maximum void space and adequate mechanical strength. It will be understood that the bead structure of the drainage board allows for the free flow of water through the material in all directions.

It is envisaged that for certain uses a plurality of laminate units each consisting of a panel of drainage board adhesively affixed to a panel of foamed polystyrene material may be first produced and then incorporated in the assembly of the roof structure. The laminate unit which is a combined thermal insulation polystyrene panel and drainage board panel has the obvious advantage of added mechanical strength—that is particularly important for the drainage board. If the laminate unit is to be used the production of the drainage board panel may be modified as suitable to allow a higher bead expansion, a higher void space, and a consequent lower mechanical strength—on the basis that the thermal insulation panel will act in the laminate unit as a strong backing for the drainage board panel and impart a satisfactory mechanical strength to the drainage board panel.

As previously mentioned, the drainage board panels are preferably of a foamed polystyrene bead material allowing a liquid to pass freely therethrough cellular thermal insulation material panels are preferably water impermeable foamed polystyrene boards.

The panel of cellular thermal insulation material 18 is provided on the relevant surface with a continuous peripheral rim 20, FIG. 3, say 5 mm high and 5 mm deep, and the drainage board panel is cut to size to fit into the recess 21 formed by the said rim 20. The depth of the drainage board panel should exceed the height of the rim. In the example where the continuous rim is 5 mm high and 5 mm deep—the drainage board panel has a depth of 20 mm. It will be appreciated that this construction avoids to any appreciable extent any capillarity, so that no water on the roof surface is drawn into contact with the thermal insulation material. An alternative to the continuous rim, as a locating means, on the panel of cellular thermal insulation material, is the provision of a plurality of spaced apart peripheral studs which serve the same function in locating and maintaining the drainage board panel in position. A further alternative to the said continuous rim, as a drainage board panel locating means, is the provision at each corner of the panel of cellular thermal insulation material of intregally moulded L-shaped corner studs 23, FIG. 5, 5 mm high, 5 mm deep and extending 50 mm on each side of the corner, to embrace the corners of the drainage board panel for firm location of the drainage board panel in position. Further it is envisaged that the drainage board locating means may comprise four extended studs or ridges 24, FIG. 6, 5 mm high and 5 mm deep and 100 mm in length each ridge being positioned centrally on each of the four sides of the panel of thermal insulation material.

Figure 1:
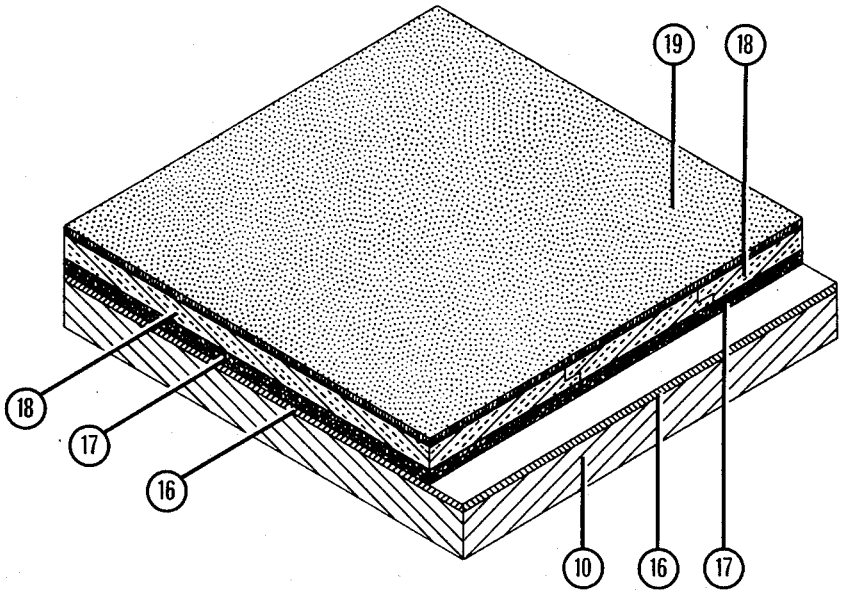
FIG. 1 is a perspective view of an embodiment of a roof structure of the present invention.

It will be understood that in use in wet weather the rain water falling upon the roof structure as illustrated in FIG. 1 of the accompanying drawings, will pass through the layer of gravel 19 and flow through the abutting joints of the overlapping longitudinal and lateral edge portion 15 of the foamed polystyrene thermal insulation layer 18. The rain water will then pass quickly through the drainage board 17 and onto the asphalt lined roof deck 10. The rain water will then flow in the said drainage board 17 and on the asphalt lined roof deck 10 to the rain water gulleys and downpipes for discharge to earth.

The roof structure is specifically designed not to offer any great resistance to the passage of rain water from the gravel layer 19 to the rain water gulleys. The fact that the rain water passes quickly through the relevant constitutent component layers of the roof structure ensures a minimum of heat loss to the water—say a 10% heat loss—and further ensures that the foamed polystyrene thermal insulation layer is not subjected at any time to the problems resultant upon the material lying in pools of water, the effect of water vapour or the absorption of water by the material itself. The quick drainage of rain water from the roof structure also avoids any tendency for the rain water in particular heavy rain water periods to cause any constitutent component layer to be subject to a buoyancy force due to water lying between any two layers of the roof structure.

In the case where the layer of cellular thermal insulation material and the drainage board are formed from a plurality of abutting laminate unit panels and a plurality of laminate unit panels jointed by overlapping longitudinal and/or lateral edge portions, the manner of use of the roof structure is essentially the same as described above in relation to the roof structure in which the layer of cellular thermal insulation material and the drainage board are separate—not laminated—roof components.

The roof structure of the present invention is particularly suited for use with flat concrete roof structures. The present invention does not require that the concrete roof be perfectly flat nor does it require for water drainage purposes that the said roof be slightly inclined to effect drainage to the water gulleys provided.

It will also be readily appreciated that the drainage board has negligible capillarity so that no water on the roof surface will, to any appreciable extent, be drawn into contact with the thermal insulation material. Further, the use of the drainage board means that no special gulley outlets have to be formed in the roof deck. The drainage board, which lies over the inlet to each gulley, acts as a filter or sieve and prevents any matter, such as gravel, entering the gulley.

The flat roof structure of the present invention may utilise concrete paving stones as a protective and weighting layer on the upper surface of the thermal insulation material. The use of concrete paving stones is particularly suitable when the roof will serve as the floor area of a roof garden.

I claim:

1. A flat roof structure comprising a roof deck supported in a conventional manner on a roof support means and, four discrete layers in the stated order, (i) a water impermeable layer on the upper surface of the roof deck, (ii) a drainage board adapted to allow water to pass freely therethrough in both vertical and horizontal directions, (iii) a layer of cellular thermal insulation material adapted to allow water to pass freely therethrough, and (iv) a water permeable protective and weighting layer on the upper surface of the cellular thermal insulation material adapted to allow water to pass freely therethrough and to provide weight for said roof structure.

2. A flat roof structure as claimed in claim 1 in which the layer of cellular thermal insulation material comprises a plurality of foamed polystyrene boards jointed together by overlapping longitudinal and/or lateral edge portions whereby the passage for water through the layer of cellular thermal insulation material is through the longitudinal and/or lateral joints.

3. A flat roof structure as claimed in claim 1 or claim 2 in which the drainage board is a foamed polystyrene bead material which allows water to pass freely therethrough.

4. A flat roof structure comprising a roof deck supported in a conventional manner on a roof support means and, four discrete layers in the stated order, (i) a water impermeable layer on the upper surface of the roof deck, (ii) a drainage board adapted to allow water to pass freely therethrough in both vertical and horizontal directions, (iii) a layer of cellular thermal insulation material adapted to allow water to pass freely therethrough, and (iv) a water permeable protective and weighting layer on the upper surface of the thermal insulation material adapted to allow water to pass freely therethrough and to provide weight for said roof structure, the drainage board and the layer of cellular thermal insulation material being formed respectively from a plurality of jointed drainage panels and a plurality of jointed panels of insulation material.

5. A flat roof structure as claimed in claim 4 in which the drainage board and the layer of cellular thermal insulation material is formed from a plurality of abutting or jointed laminate panel units, each panel unit being formed by securing together as a laminate a drainage board panel and a panel of the insulation material.

6. A flat roof structure as claimed in claim 5 in which the panels of insulation material which form the layer of insulation material are each provided with means to locate and hold in position a complementary drainage board panel for the securing together of the said panel of insulation material and the drainage board panel to form the laminate panel unit.

7. A flat roof structure as claimed in claim 6 in which the means to locate and hold in position the complementary drainage board panel is a continuous peripheral rim moulded intregal with the panel of cellular thermal insulation material.

8. A flat roof structure as claimed in claim 6 in which the means to locate and hold in position the complementary drainage board panel is a series of spaced apart studs on the periphery of the panel of cellular thermal insulation material or L-shaped corner studs provided at each corner of the panel of cellular thermal insulation material.

* * * * *